US011350774B2

(12) United States Patent
Sirois

(10) Patent No.: US 11,350,774 B2
(45) Date of Patent: Jun. 7, 2022

(54) PILLOW WITH SEPARATE INTERIOR COMPARTMENTS

(71) Applicant: Thomas J. Sirois, Wolcott, CT (US)

(72) Inventor: Thomas J. Sirois, Wolcott, CT (US)

( * ) Notice: Subject to any disclaimer, the term of this patent is extended or adjusted under 35 U.S.C. 154(b) by 0 days.

(21) Appl. No.: 16/156,638

(22) Filed: Oct. 10, 2018

(65) Prior Publication Data

US 2020/0113358 A1 Apr. 16, 2020

(51) Int. Cl.

| | |
|---|---|
| ***A47G 9/10*** | (2006.01) |
| ***B68G 7/06*** | (2006.01) |
| ***B68G 1/00*** | (2006.01) |

(52) U.S. Cl.

CPC ..... *A47G 9/10* (2013.01); *B68G 1/00* (2013.01); *B68G 7/06* (2013.01); *A47G 2009/1018* (2013.01); *B68G 2001/005* (2013.01)

(58) Field of Classification Search

CPC ... A47G 9/10; A47G 9/109; A47G 2009/1018
See application file for complete search history.

(56) References Cited

U.S. PATENT DOCUMENTS 1,846,312 A * 2/1932 Coghlan ..... A47C 27/05 5/642
2,589,303 A * 3/1952 Sourbeck ..... A47G 9/10 5/645
2,805,428 A * 9/1957 Buchman ..... A47G 9/10 5/645

(Continued)

FOREIGN PATENT DOCUMENTS

GB 2256795 A * 12/1992 ..... A47C 27/121
GB 2256795 A 12/1992

(Continued)

OTHER PUBLICATIONS

Amazon.com; "Hotel Collection Triple Compartment Feather and Down Pillow, Medium King"; https://www.amazon.com/Collection-Triple-Compartment-Feather-Pillow/dp/B0062YFGY8; Dec. 28, 2015.

(Continued)

*Primary Examiner* — David R Hare
*Assistant Examiner* — Amanda L Bailey
(74) *Attorney, Agent, or Firm* — St. Onge Steward Johnston & Reens LLC

(57) ABSTRACT

A pillow including a pillow-liner having an upper liner, a lower liner, and at least one middle liner. The upper liner, lower liner, and at least one middle liner are sealed together adjacent peripheral edges thereof to define an open end and at least two internal compartments. The at least one middle liner is generally parallel with the upper and lower liners. The pillow also includes cushioning materials for filling the at least two internal compartments. Each of the at least two internal compartments are filled with different cushioning materials such that the internal compartments have different density and firmness when filled with the respective cushioning materials. At least one of the at least two internal compartments is filled with a plurality of loose pieces of a shredded foam material, and at least one of the at least two internal compartments is filled with a one-piece molded foam material.

7 Claims, 3 Drawing Sheets

(56) References Cited

U.S. PATENT DOCUMENTS

| | | | | |
|---|---|---|---|---|
| 2,944,266 | A * | 7/1960 | Wertheimer | A47G 9/10 5/645 |
| 3,323,152 | A * | 6/1967 | Lerman | A47C 27/144 5/655.9 |
| 3,443,267 | A * | 5/1969 | Meyers | A47G 9/10 5/645 |
| 4,064,578 | A * | 12/1977 | Yamada | A47C 7/021 297/452.27 |
| 4,756,035 | A | 7/1988 | Beier | |
| 5,038,432 | A | 8/1991 | Robillard et al. | |
| 5,471,691 | A | 12/1995 | Ryndak | |
| 5,557,816 | A * | 9/1996 | Pedersen | A47G 9/0207 112/475.08 |
| 6,952,848 | B1 | 10/2005 | Strunk-Fellows | |
| 7,051,389 | B2 * | 5/2006 | Wassilefky | A47G 9/10 5/490 |
| 7,530,127 | B2 | 5/2009 | Leifermann et al. | |
| 7,681,263 | B1 | 3/2010 | Hawkins | |
| 7,788,750 | B2 | 9/2010 | Norstrem | |
| 7,900,303 | B2 | 3/2011 | Mastrosimone-Gese | |
| 8,127,382 | B1 * | 3/2012 | Plascencia | A47G 9/1045 5/490 |
| 2009/0199341 | A1 | 8/2009 | Schantz | |
| 2012/0066837 | A1 | 3/2012 | Thorsen et al. | |
| 2012/0102654 | A1 * | 5/2012 | Lee | A47G 9/0253 5/645 |
| 2013/0263377 | A1 * | 10/2013 | Wootten, Jr. | A47C 23/00 5/640 |
| 2015/0074911 | A1 * | 3/2015 | Dungan | A47G 9/1036 5/636 |
| 2017/0340131 | A1 * | 11/2017 | Schmidt | A47C 27/144 |
| 2018/0199738 | A1 | 7/2018 | Klein | |
| 2018/0213954 | A1 * | 8/2018 | Grinstead | A47G 9/10 |
| 2019/0133349 | A1 * | 5/2019 | Fux | A47G 9/10 |

FOREIGN PATENT DOCUMENTS

| | | | |
|---|---|---|---|
| GB | 2488126 | A | 8/2012 |
| KR | 20050026454 | A | 3/2005 |

OTHER PUBLICATIONS

Overstock.com; "Luxury Down Compartment Sleep Pillow"; https://www.overstock.com/Bedding-Bath/Luxury-Down-Dompartment-Sleep-Pillow-Set-of-2/10596646/product.html; Nov. 24, 2015.

Sammi Pillows; "Sammi Generation 1 Premier Model"; https://www.sammipillows.com/premier-model.html; Aug. 17, 2018.

International Search Report and Written Opinion of the International Searching Authority Application No. PCT/US2019/055371 dated Nov. 5, 2019 (12 pages).

* cited by examiner

PILLOW WITH SEPARATE INTERIOR COMPARTMENTS

FIELD OF THE INVENTION

The present invention relates to cushion constructions. More particularly, the invention relates to pillows having vertically stacked interior compartments filled with different cushioning materials to enhance sleep quality by optimizing a user's sleep posture.

BACKGROUND OF THE INVENTION

Pillows are generally used to support a person's head and neck while sleeping. The thickness and firmness of the pillow required for optimal support varies depending on the user's physiology and preferred sleeping position. For example, side sleepers require thicker and firmer pillows than back or stomach sleepers. Failure to provide optimal head and neck support results in poor sleep quality and risks neck injury.

Some people do not have a preferred sleeping position and will rotate between positions throughout their sleep cycle. For these people, a pillow designed for a specific sleep position does not permit them to achieve optimal sleeping posture in their variety of positions. To correct this, pillows have been constructed having zones and/or plateaus arranged horizontally across the pillow, with each zone/plateau designed to support a different sleep position. However, these pillows restrict the user's head to a small portion of the pillow for each respective position. This restriction increases the pillow's deterioration rate at those specific locations, and denies the user positional freedom across the pillow.

What is needed, therefore, is a pillow and a construction method that will permit a user to achieve optimal sleep posture in a variety of sleeping positions without limiting the user's choice as to head placement across the pillow. Such a pillow and construction method should also provide improved durability of the pillow.

SUMMARY OF THE INVENTION

Accordingly, it is an object of the present invention to provide a pillow that supports a user's head and neck to enhance sleep quality by optimizing sleep posture. It is another object of the present invention to construct a pillow or cushion having vertically stacked internal compartments filled with different cushioning materials. It is yet another object of the present invention that the internal compartments have different density and firmness when filled with the respective different cushioning materials.

These and other objects of the present invention are achieved by providing a pillow including a pillow-liner having an upper liner, a lower liner, and at least one middle liner. The upper liner, the lower liner, and the at least one middle liner are sealed together adjacent peripheral edges thereof to define an open end and at least two internal compartments. The at least one middle liner is generally parallel with the upper and lower liners. The pillow also includes cushioning materials for filling the at least two internal compartments. Each of the at least two internal compartments are filled with different cushioning materials such that the internal compartments have different density and firmness when filled with the respective cushioning materials.

In some embodiments, each of the at least two internal compartments spans substantially the entire width of the pillow-liner, substantially the entire length of the pillow-liner, and a portion of the height of the pillow-liner.

In some embodiments, the ratio of the cushioning material density of one of the at least two internal compartments to the cushioning material density of another of the at least two internal compartments is in the range of about 1:1 to about 1:8. In other embodiments, the ratio of the cushioning material density of one of the at least two internal compartments to the cushioning material density of another of the at least two internal compartments is in the range of about 1:1 to about 1:5.

In some embodiments, at least one of the at least two internal compartments is filled with a plurality of loose pieces of a shredded foam material, and at least one of the at least two internal compartments is filled with a one-piece molded foam material.

In some embodiments, the pillow-liner includes two middle liners defining three internal compartments arranged to form an upper compartment, a middle compartment, and a lower compartment. The upper and lower compartments are each filled with a one-piece molded foam material, and the middle compartment is filled with a plurality of loose pieces of a shredded foam material.

In some embodiments, the open end of the pillow-liner is sealed after the at least two internal compartments are filled with the cushioning materials.

In another embodiment of the present invention, a cushion having an upper casing, a lower casing, and at least one side casing is provided. The upper casing, the lower casing, and the at least one side casing is sealed together adjacent peripheral edges thereof to form a case. The cushion also includes at least one interior wall affixed to the at least one side casing and disposed laterally across a length and a width of the case to define at least two internal compartments of the case such that each of the at least two internal compartments spans substantially the entire width of the case, substantially the entire length of the case, and a portion of the height of the case. The cushion further includes at least one opening along a surface of the case, and cushioning materials for filling the case. At least one of the at least two internal compartments is filled with different cushioning materials than another one of the at least two internal compartments such that the internal compartments have different density and firmness when filled with the respective cushioning materials.

In some embodiments, the at least one interior wall is generally parallel with the upper and lower casings.

In some embodiments, the ratio of the cushioning material density of one of the at least two internal compartments to the cushioning material density of another of the at least two internal compartments is in the range of about 1:1 to about 1:8. In other embodiments, the ratio of the cushioning material density of one of the at least two internal compartments to the cushioning material density of another of the at least two internal compartments is in the range of about 1:1 to about 1:5.

In some embodiments, at least one of the at least two internal compartments is filled with a plurality of loose pieces of a shredded foam material, and at least one of the at least two internal compartments is filled with a one-piece molded foam material.

In some embodiments, the cushion includes two interior walls defining three internal compartments arranged to form an upper compartment, a middle compartment, and a lower compartment. The upper and lower compartments are each filled with a one-piece molded foam material, and the middle compartment is filled with a plurality of loose pieces of a shredded foam material.

In some embodiments, the at least one opening along a surface of the case is sealed after the at least two internal compartments are filled with the cushioning materials.

In an alternative embodiment of the present invention, a method of forming a cushion is provided. The method includes the steps of: forming a case having a closed end and an open end; installing at least one wall in the case to form at least two internal compartments such that each of the at least two internal compartments spans substantially the entire width of the case, substantially the entire length of the case, and a portion of the height of the case; filling the at least two internal compartments with cushioning materials such that at least one of the internal compartments is filled with different cushioning materials than the other internal compartments such that the internal compartments have different density and firmness when filled with the respective cushioning materials; and sealing the open end of the case.

In some embodiments, the at least one wall is generally parallel with an upper surface and a lower surface of the case.

In some embodiments, the ratio of the cushioning material density of one of the at least two internal compartments to the cushioning material density of another of the at least two internal compartments is in the range of about 1:1 to about 1:8. In other embodiments, the ratio of the cushioning material density of one of the at least two internal compartments to the cushioning material density of another of the at least two internal compartments is in the range of about 1:1 to about 1:5.

In some embodiments, at least one of the at least two internal compartments is filled with a plurality of loose pieces of a shredded foam material, and at least one of the at least two internal compartments is filled with a one-piece molded foam material.

In some embodiments, the installing step also includes two walls defining three internal compartments arranged to form an upper compartment, a middle compartment, and a lower compartment. The upper and lower compartments are each filled with a one-piece molded foam material, and the middle compartment is filled with a plurality of loose pieces of a shredded foam material.

DETAILED DESCRIPTION OF THE INVENTION

Figure 1:
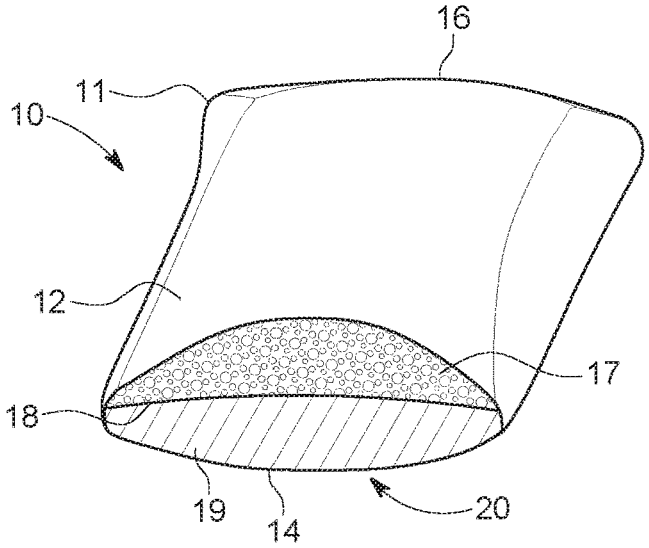
FIG. 1 is a perspective view of a pillow having an open end according to a first embodiment of the present invention.

Referring now to the drawing figures, wherein like reference numerals designate corresponding structures throughout the views. The following examples are presented to further illustrate and explain the present invention and should not be taken as limiting in any regard.

FIG. 1 shows a pillow 10 having a pillow-liner 11. The pillow-liner 11 has an upper liner 12, a lower liner 14, and a middle liner 18. The upper liner 12 and the lower liner 14 are sealed together adjacent peripheral edges such that the pillow-liner has a closed end 16 and an open end 20. The middle liner 18 is sealed to the upper liner 12 and/or the lower liner 14 adjacent peripheral edges to define two separate internal compartments 17/19. The pillow-liner 11 is formed of any appropriate casing/lining material known in the art, such as cotton, nylon, synthetic materials, and the like.

In preferred embodiments, the middle liner 18 is generally parallel to the upper liner 12 and the lower liner 14 such that the internal compartments 17/19 are stacked on top of each other in alignment with an axis perpendicular to the length and width of the pillow-liner 11. Internal compartments 17/19 each span substantially the entire length of the pillow-liner 11, substantially the entire width of the pillow-liner 11, and a portion of the height of the pillow-liner 11. In some embodiments, each of the internal compartments 17/19 spans about 30-70% of the height of the pillow-liner 11. In other embodiments, each of the internal compartments 17/19 spans about 40-60% of the height of the pillow-liner 11. In preferred embodiments, each of the internal compartments 17/19 spans about 50% of the height of the pillow-liner 11.

Figure 3:
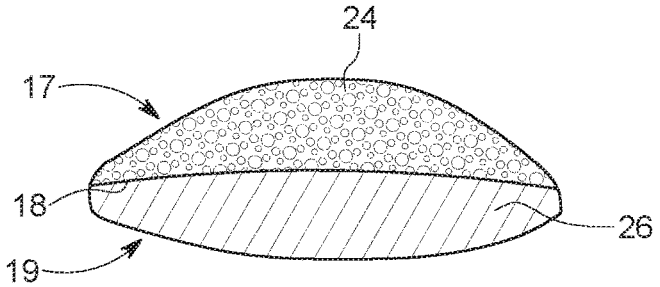
FIG. 3 is an elevational cross-section view of the pillow of FIG. 2 along the line A-A.

Preferably, the internal compartments 17/19 are filled with different cushioning materials. Any cushioning material known in the art is appropriate, such as, for example, talalay latex foam; Dunlop latex foam; polyurethane foam; shredded latex foam; latex foam enhanced with graphite, gel, copper, etc.; memory foam; down; goose feathers; latex materials, synthetic materials, natural materials, and blends thereof; bladders filled with fluids such as air, water, gel, and various liquids and gases; and the like. As used herein, different cushioning materials refers to chemical/molecular differences (e.g. latex foam being different than polyurethane foam), physical differences (e.g. shredded foam being different than a one-piece foam), structural differences (e.g. shredded foam of one size/shape being different than shredded foam of another size/shape), and the like. In preferred embodiments, internal compartment 17 is filled with a plurality of shredded foam material 24, and internal compartment 19 is filled with a one-piece molded solid foam material 26, as shown in FIG. 3. In some embodiments, internal compartment 17 is filled with a one-piece latex foam having a first density and firmness, and internal compartment 19 is filled with a one-piece latex foam having a second density and firmness. In other embodiments, internal compartment 17 is filled with a plurality of shredded latex foam having a first particle size and density, and internal compartment 19 is filled with a plurality of shredded latex foam having a second particle size and density. In other embodiments, one of the internal compartments is filled with a bladder containing a fluid such as air, water, gel, and the like. The bladder has an ingress/egress valve that protrudes through a hole in the pillow-liner 11 such that a user can adjust the cushioning of the bladder by adding fluid to, or removing fluid from, the bladder. Preferably, the bladder is secured to the pillow-liner 11 via stitching, ultrasonic heat sealing, and the like.

Thus, by filling each internal compartment with a different cushioning material, each internal compartment offers a different level of head/neck support such that generally the entire surface of the upper liner 12 of the pillow-liner 11 can be used for one sleeping position, while generally the entire surface of the lower liner 14 of the pillow-liner 11 can be used for another sleeping position. For example, one internal compartment can be filled with a firm, dense material to optimally support the user sleeping in a side position, and the other internal compartment can be filled with a soft, loosely packed material to optimally support the user sleeping in a back or stomach position. In some embodiments, the ratio of the cushioning material density of one internal compartment to the cushioning material density of the other internal compartment is in the range of about 1:1 to about 1:8. In preferred embodiments, the density ratio between internal compartments is in the range of about 1:1 to about 1:5.

In some embodiments, the pillow-liner 11 includes at least two middle liners 18 defining at least three internal compartments. At least two of the at least three internal compartments are filled with different cushioning materials, and preferably each of the at least three internal compartments are filled with different cushioning materials.

Figure 2:
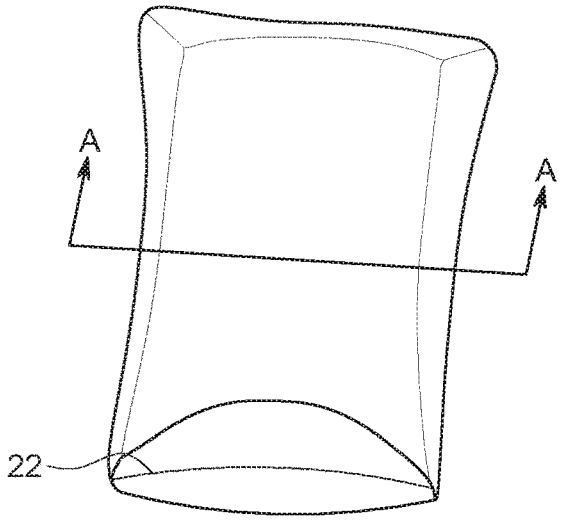
FIG. 2 is a perspective view of the pillow of FIG. 1 with the open end sealed.

After the pillow-liner 11 is filled with cushioning materials, the open end 20 is preferably sealed to contain the cushioning materials in the pillow-liner 11. In some embodiments, the open end 20 is sealed using stitching 22, as depicted in FIG. 2. In some embodiments, the open end 20 is sealed using ultrasonic heat sealing. In other embodiments, the open end 20 is releasably sealed using any appropriate fasteners known in the art, such as zipper, hook and loop, snaps, buttons, and the like. Thus, a user can customize the internal compartments and replace the cushioning material as needed. Also, the pillow 10 can be removably inserted into a pillowcase (not shown) to help keep the pillow 10 clean during use.

Figure 4:
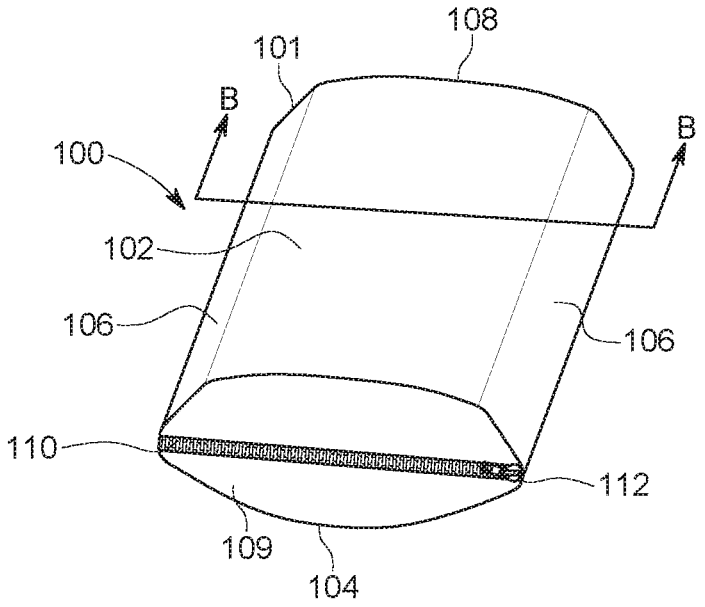
FIG. 4 is a perspective view of a cushion according to a second embodiment of the present invention.
Figure 5:
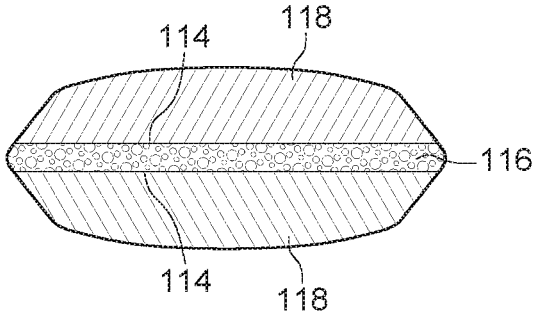
FIG. 5 is an elevational cross-section view of the cushion of FIG. 4 along the line B-B.
Figure 6:
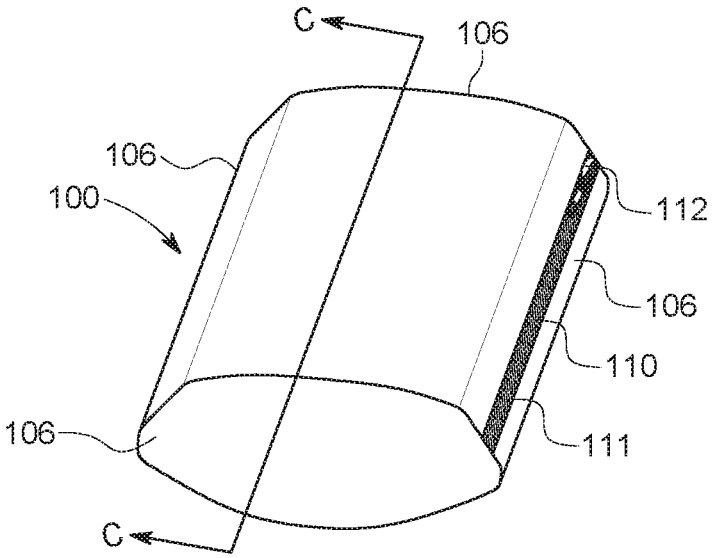
FIG. 6 is a perspective view of a cushion according to a third embodiment of the present invention.
Figure 7:
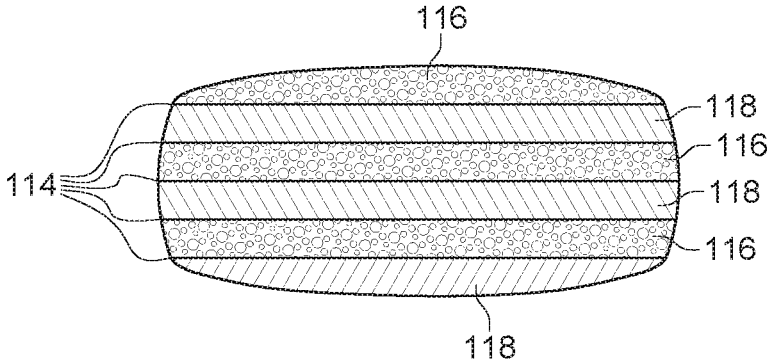
FIG. 7 is an elevational cross-section view of the cushion of FIG. 6 along the line C-C.

FIG. 4 shows a cushion 100 having according to another embodiment of the present invention. The cushion 100 has an upper casing 102, a lower casing 104, and at least one side casing 106. The upper casing 102, the lower casing 104, and the side casings 106 are sealed together adjacent peripheral edges thereof to form a case 101 having a closed end 108 and an open end 109. The cushion 100 includes at least one interior wall 114 defining at least two internal compartments. In some embodiments, the cushion 100 includes at least two interior walls 114 defining at least three internal compartments, as depicted in FIG. 5. It is contemplated that the cushion 100 can include any number of interior walls 114. For example, FIGS. 6-7 show a cushion 100 having five interior walls 114 defining six internal compartments. Preferably, the interior walls 114 are affixed to the side casings 106 and disposed laterally across a length and a width of the cushion 100 such that each of the internal compartments are stacked on top of each other in alignment with an axis perpendicular to the length and width of the cushion 100. Each of the internal compartments spans substantially the entire width of the cushion 100, substantially the entire length of the cushion 100, and a portion of the height of the cushion 100.

Preferably, at least two internal compartments are filled with different cushioning materials. For example, FIG. 5 shows a cushion having an upper compartment filled with a one-piece foam material 118, a middle compartment filled with a plurality of shredded foam material 116, and a lower compartment filled with a one-piece foam material 118. In some embodiments, the upper and lower compartments are filled with different one-piece foam materials 118 such that the top and bottom of the cushion offer different levels of support. Similarly, the six internal compartments shown in FIG. 7 are filled with an alternating pattern of shredded foam material 116 and one-piece foam material 118. It is contemplated that the internal compartments can be filled with any number of cushion material arrangements. In preferred embodiments, the upper compartment is filled with a shredded foam material 116 and the lower compartment is filled with a one-piece foam material 118, or vice versa. In some embodiments, the ratio of the cushioning material density of one internal compartment to the cushioning material density of another internal compartment is in the range of about 1:1 to about 1:8. In preferred embodiments, the density ratio between internal compartments is in the range of about 1:1 to about 1:5.

After the cushion 100 is filled with cushioning materials, the open end 109 is preferably sealed to contain the cushioning materials in the cushion 100. In some embodiments, the open end 109 is releasably sealed using interlocking teeth 110 fastened together by zip slider 112, as depicted in FIGS. 4 and 6. In other embodiments, the open end 109 is releasably sealed using any appropriate fasteners known in the art, such as hook and loop, snaps, buttons, and the like. Thus, a user can customize the internal compartments and replace the cushioning material as needed. In other embodiments, the open end 109 is sealed using stitching or ultrasonic heat sealing. In some embodiments, the internal compartments are accessible via an opening 111 along a surface of the case 101. For example, FIG. 6 shows a cushion 100 having an opening 111 in a side casing 106 and positioned to generally align with the longitudinal axis of the cushion 100. In some embodiments, the cushion 100 has a plurality of openings 111, one for each internal compartment, such that each internal compartment is independently accessible through its own opening 111 and to ensure that the different cushioning materials remains in the respective internal compartments.

Although the drawing figures show the cushion 100 having a generally rectangular shape, it is contemplated that the cushion 100 can be differently shaped and sized depending on its use. For example, the cushion 100 can be adapted for use as a pillow, sofa cushion, chair cushion, pet-bed, mattress top cover, mattress, and the like.

Although the invention has been described with reference to a particular arrangement of parts, features, and the like, these are not intended to exhaust all possible arrangements or features, and indeed many other modifications are variations will be ascertainable to those of skill in the art.

What is claimed is:

1. A pillow comprising:

a pillow-liner comprising an upper liner, a lower liner, at least one side casing and at least two middle liners, wherein peripheral edges of the upper liner are sealed with a first set of peripheral edges of the at least one side casing and peripheral edges of the lower liner are sealed with a second set of peripheral edges of the at least one side casing, and the at least two middle liners are fixed to the at least one side casing to define at least three internal compartments, wherein each of the at least three internal compartments extends substantially the entire width and length of the pillow liner; and cushioning materials for filling the at least three internal compartments, each of the at least three internal compartments having a maximum height when filled with the respective cushioning materials;

wherein at least two of the at least three internal compartments are filled with different cushioning materials such that the at least two of the at least three internal compartments have different maximum heights, density and firmness when filled with the respective cushioning materials, wherein the at least three internal compartments are sealed after being filled with cushioning materials such that the cushioning materials are intended not to be removable by a user;

a first internal compartment of the at least three internal compartments being adjacent a first side of the pillow-liner defined by the upper liner, the first internal compartment being filled with one of a one-piece molded foam material and a plurality of loose pieces of a shredded foam material such that the first side of the pillow-liner is configured to support the user's head and neck while sleeping in a first sleeping position;

a second internal compartment of the at least three internal compartments being adjacent a second side of the pillow-liner defined by the lower liner, the second internal compartment being filled with one of a plurality of loose pieces of a shredded foam material and a one-piece molded foam material such that the second side of the pillow-liner is configured to support the user's head and neck while sleeping in a second sleeping position; and a third internal compartment of the at least three internal compartments being filled with one of a one-piece molded foam material and a plurality of loose pieces of a shredded foam material, wherein the third internal compartment has a side wall formed by at least a portion of the at least one side casing, wherein the side wall has a side wall height;

wherein said third internal compartment is non-fixable at a different height other than the side wall height once the compartments are sealed after being filled with the respective cushioning materials.

2. The pillow of claim 1, wherein the ratio of the cushioning material density of one of the at least three internal compartments to the cushioning material density of the other two of the at least three internal compartments is in the range of about 1:1 to about 1:8.

3. The pillow of claim 1, wherein the ratio of the cushioning material density of one of the at least three internal compartments to the cushioning material density of the other two of the at least three internal compartments is in the range of about 1:1 to about 1:5.

4. A method of forming a cushion comprising the steps of:

forming a case having an upper wall, a lower wall, a closed end, at least one side casing, and an open end;

installing at least two middle walls in the case between the upper wall and the lower wall to form at least three internal compartments, wherein each internal compartment extends the entire width and length of the case, and wherein each of the at least three internal compartments is adjacent another of the at least three internal compartments such that each of the adjacent internal compartments share a common wall that extends the entire width and length of the case;

filling a first of the at least three internal compartments with one of a one-piece molded foam material and a plurality of loose pieces of a shredded foam material;

filling a second of the at least three internal compartments with one of a plurality of loose pieces of a shredded foam material and a one-piece molded foam material;

filling a third of the at least three internal compartments with one of a one-piece molded foam material and a plurality of loose pieces of a shredded foam material wherein the third internal compartment has a side wall formed by at least a portion of the at least one side casing, wherein the side wall has a side wall height; and sealing the open end of the case such that the one-piece molded foam material and the shredded foam material are intended not to be removable by a user;

wherein each of the at least three internal compartments has a maximum height when filled with the respective cushioning materials;

wherein at least two of the at least three internal compartments are filled with different cushioning materials and have different maximum heights, density and firmness when filled with the respective cushioning materials such that a side of the case defined by the upper wall is configured to optimally support the user's head and neck while sleeping in a first position and a side of the case defined by the lower wall is configured to optimally support the user's head and neck while sleeping in a second position; and wherein said third internal compartment is non-fixable at a different height other than the side wall height once the compartments are sealed after being filled with the respective cushioning materials.

5. The method of claim 4, wherein the ratio of the cushioning material density of one of the at least three internal compartments to the cushioning material density of the other two of the at least three internal compartments is in the range of about 1:1 to about 1:8.

6. The method of claim 4, wherein the ratio of the cushioning material density of one of the at least three internal compartments to the cushioning material density of the other two of the at least three internal compartments is in the range of about 1:1 to about 1:5.

7. The method of claim 4, wherein the at least three internal compartments comprise an upper compartment, a middle compartment and a lower compartment, and; wherein the upper and lower compartments are each filled with the one-piece molded foam material, and the middle compartment is filled with the plurality of loose pieces of a shredded foam material.

* * * * *